US007084719B2

(12) United States Patent
Carpintero et al.

(10) Patent No.: US 7,084,719 B2
(45) Date of Patent: Aug. 1, 2006

(54) DIELECTRIC RESONATOR FILTER

(75) Inventors: Isidro Hidalgo Carpintero, Madrid (ES); Manuel Jesus Padilla Cruz, Tres Cantos—Madrid (ES); Rafael Tapia Guijarro, Madrid (ES)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/815,719

(22) Filed: Apr. 2, 2004

(65) Prior Publication Data

US 2004/0227593 A1 Nov. 18, 2004

(30) Foreign Application Priority Data

Apr. 4, 2003 (EP) ..... 03290841

(51) Int. Cl.
*H01P 1/20* (2006.01)
*H01P 1/208* (2006.01)

(52) U.S. Cl. ..... 333/202; 333/212

(58) Field of Classification Search ..... 333/202, 333/212, 219.1, 206, 99 S, 230
See application file for complete search history.

(56) References Cited

U.S. PATENT DOCUMENTS 5,157,363 A * 10/1992 Puurunen et al. ..... 333/202
5,608,363 A * 3/1997 Cameron et al. ..... 333/202
5,805,033 A * 9/1998 Liang et al. ..... 333/202
6,239,673 B1 * 5/2001 Wenzel et al. ..... 333/202
6,342,825 B1 * 1/2002 Hershtig ..... 333/202
6,522,225 B1 * 2/2003 Liang et al. ..... 333/202
6,559,740 B1 * 5/2003 Schulz et al. ..... 333/202

* cited by examiner

*Primary Examiner*—Seungsook Ham
(74) *Attorney, Agent, or Firm*—Sughrue Mion, PLLC

(57) ABSTRACT

A direct coupled resonator filter having a plurality of resonant cavities (15) such that they are separated by inner walls (18) and a coupling structure (16) couples two adjoining resonant cavities (15) since the coupling structure is located in a slot (20) defined in the inner wall (18). Thus, a portion of an edge of the slot (20) comes into electrical contact with the coupling structure (16). In general, this portion of the edge of the slot (20) corresponds to a horizontal edge surface of the inner wall (18). It should be noted that the coupling structure (16) is perpendicular to a vertical plane defined by the slot (20).

13 Claims, 2 Drawing Sheets

DIELECTRIC RESONATOR FILTER

OBJECT OF THE INVENTION

The present invention relates to a direct coupled resonator filter that uses coupling devices to transmit a high electromagnetic wave from the filter input to the filter output through a plurality of resonator cavities.

STATE OF THE ART

A microwave resonator filter is known from Smith's U.S. Pat. No. 6,255,919 which describes a bandpass filter having an enclosure structure which defines four cavities. Each cavity contains a resonator, respectively. The filter includes input and output devices for receiving and transmitting an electromagnetic wave such as electromagnetic waves of high power. The wave is filtered upon passing through the resonators and the cavities. The resonators in the cavities are coupled through the use of a coupling structure which is located between the adjacent sequential cavities.

Thus, the filter receives an electromagnetic wave through an input device which is coupled to the first resonator. The electromagnetic wave is transmitted to another resonator through a coupling member, and is transmitted from the filter by an output device, which is coupled to the last resonator. The microwave filter allows a predetermined passband of the received wave to pass through the filter.

The outer wall structure has a rectangular configuration defined by a front wall, a rear wall, and a pair of opposite end walls. The input and output devices are mounted on the front wall near opposite ends of the front wall. Obviously, the peripheral outer wall structure surrounds the four cavities and further includes an inner wall structure separating one cavity from the other cavities.

Two resonators, located in adjacent sequential cavities, are coupled by means of one coupling structure which is attached at the outer wall, and projects longitudinally from the outer wall over the upper edge surface of one inner wall. Therefore, the coupling structure and the upper edge surface are elongated in the directions that are parallel to each other, and further the coupling structure is perpendicular to the wave path.

The inner wall is shorter than the outer wall. Thus, a gap is defined between a closure wall and the upper edge surface of the inner wall, and the coupling structure is in the gap directly above the upper edge surface in spaced relationship thereto and to the closure wall. A pair of screws supports the coupling structure on the rear wall in this position.

A disadvantage with the microwave filter known from U.S. Pat. No. 6,255,919 is that the coupling structure can only be located at the outer wall and is always perpendicular to the wave path. On the other hand, the coupling structure can never be located between non-adjacent non-sequential cavities because the coupling structure is fastened to the outer wall. As a result, diagonal cross coupling cannot be provided. Moreover, in some specific cases the coupling structure cannot be implemented between adjacent non-sequential cavities.

Accordingly, there is the need to provide a resonant cavity filter including such coupling structure for any pair of neighboring cavities of the housing filter.

Consequently, the coupling means should be located perpendicular to a vertical plane defined by a slot located in the inner wall, such that the inner wall comes into electric contact with the coupling means and, therefore, the heat generated during the performance of the filter can be dissipated.

CHARACTERISATION OF THE INVENTION

In accordance with the present invention, a direct coupled resonator filter having a plurality of resonant cavities such that they are separated by means of inner walls and a coupling means couples two adjoining resonant cavities since the coupling means is located in a slot defined in the inner wall. Thus, a portion of an edge of the slot comes into electric contact with the coupling means. In general, this portion of the edge of the slot corresponds to a horizontal edge surface of the inner wall. It should be noted that the coupling means is perpendicular to a vertical plane defined by the slot.

Accordingly, it is an object of the present invention to provide a coupling means that enables coupling between adjacent sequential resonant cavities, adjacent non-sequential resonant cavities and non-adjacent non-sequential cavities.

Another object of the invention is to provide an optimum thermal path for evacuation of the heat that is generated during high power operation since the inner wall come into electric contact with the coupling means, namely, physical contact between these two metallic elements.

Therefore, the heat generated as an electromagnetic wave of greater power passing through the resonant cavities of the filter can be dissipated.

BRIEF DESCRIPTION OF THE DRAWINGS

The characteristics and advantages of the invention will become clearer with a detailed description thereof, taken together with the attached drawings, in which.

DESCRIPTION OF THE INVENTION

Figure 1:
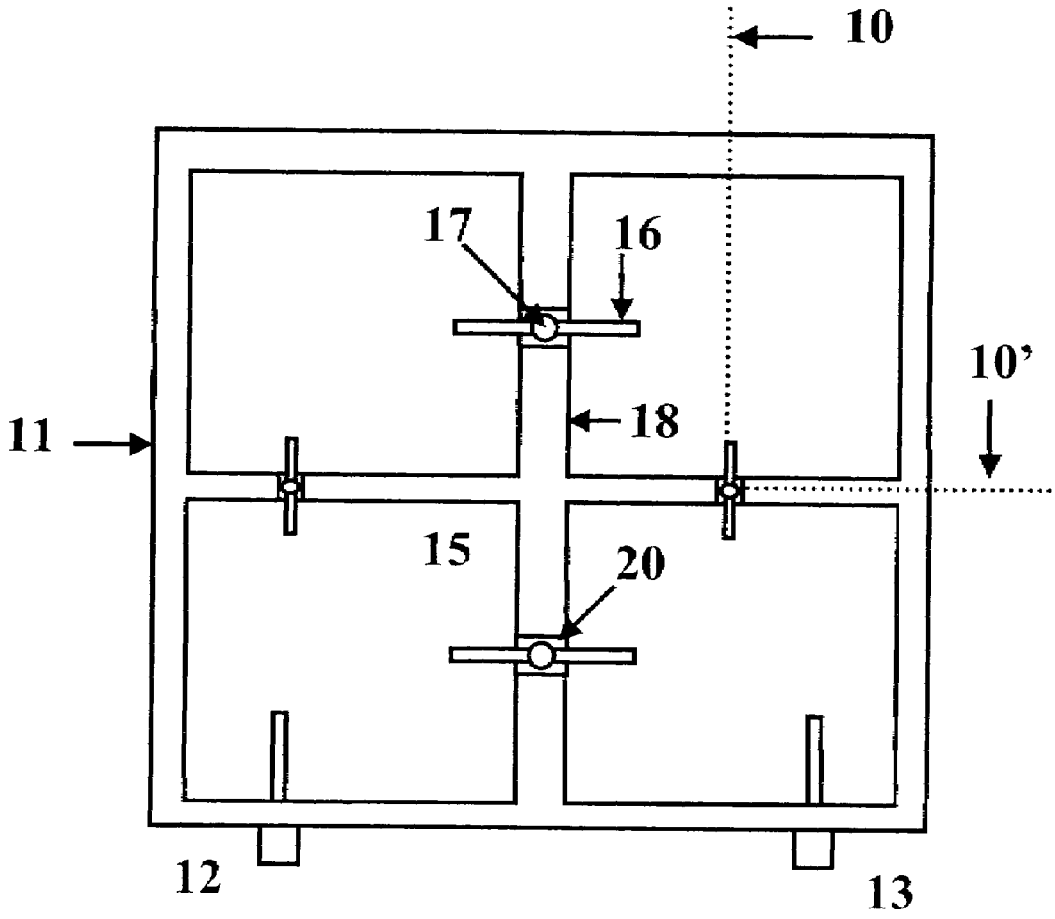
FIG. 1 is a plane view of an embodiment of a cavity filter with a part of the housing removed in accordance with the invention.
Figure 3:
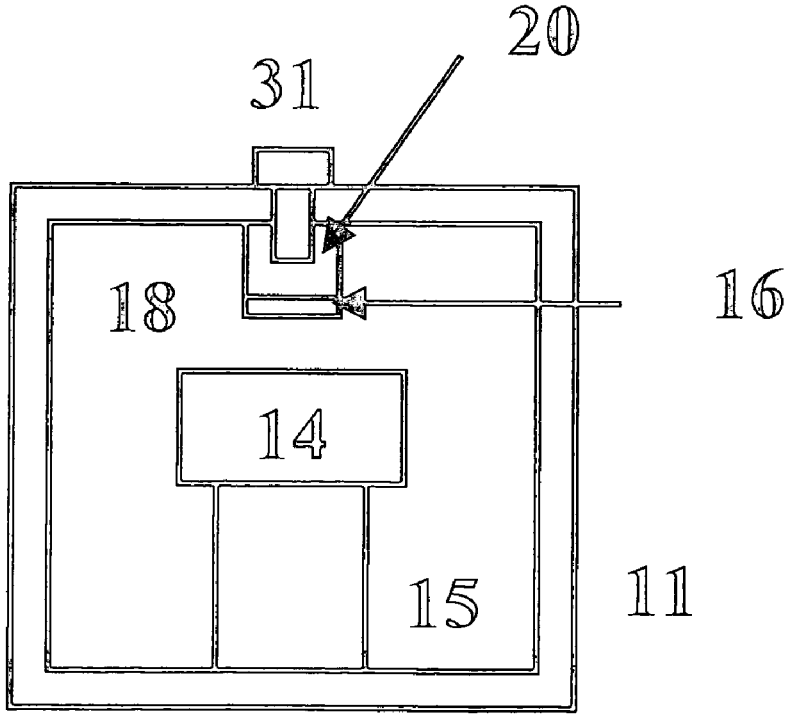
FIG. 3 is a view taken on line 10—10' of a resonant cavity of the filter including a resonator in accordance with the invention.

FIG. 1 illustrates an enclosure 11 of a direct coupled resonator filter which defines a plurality of resonant cavities 15. As illustrated in FIG. 3, each cavity 15 could contain a resonator 14, respectively. The resonator 14 can be dielectric, coaxial, or the like.

Turning now to FIG. 1, the filter further includes input and output devices 12 and 13 for receiving and transmitting an electromagnetic wave of greater power. The wave is filtered upon passing through the resonant cavities 15.

The enclosure 11 includes a peripheral outer wall surrounding the resonant cavities 15, such that an inner wall 18 is defined for separating two adjoining resonant cavities 15. A base wall of the housing defines the bottom of the filter housing 11. For example, an upper lid could cover the cavities 15, not shown for the sake of clarity. Input 12 and output 13 devices are provided and mounted on the same side of the housing 11. Note that they can be located in different sides of the housing filter.

The filter having coupling 16 means is configured to couple the resonant cavities 15 for filtering of a high power greater electromagnetic wave between the input 12 and output 13 devices.

Figure 2:
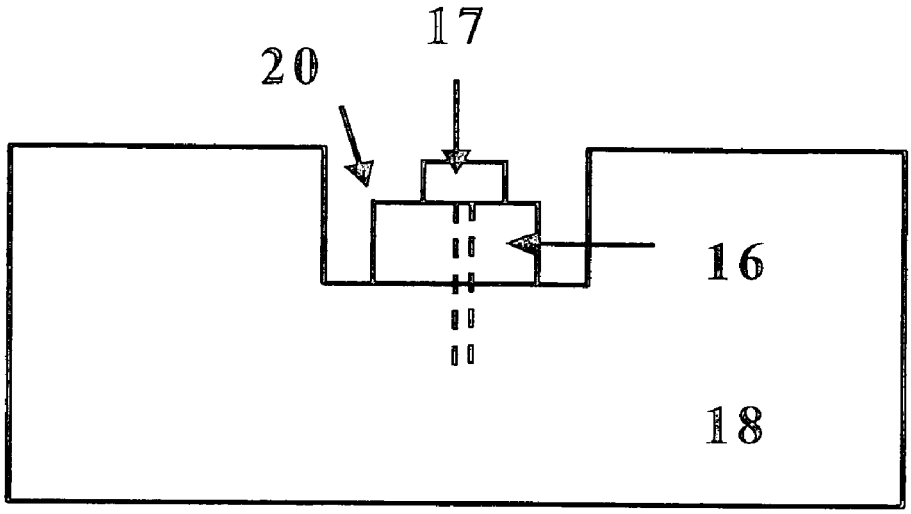
FIG. 2 is a view of the an inner wall of the filter housing in accordance with the invention.

As illustrated in FIG. 2, each inner 18 wall comes into contact with the base wall and upper lid of the housing 11 except in a shorter portion 20. Thus, a slot 20 is defined in the upper edge surface of the inner 18 wall. This slot 20 is suitable to receive the coupling 16 element or probe, such that the probe 16 is perpendicular to a vertical plane defined by the slot 20.

Accordingly, adjacent sequential cavities, adjacent non-sequential cavities and non-adjacent non-sequential cavities can be coupled through the use of probes 16.

The probe 16 is located in the slot 20 directly above its horizontal edge surface, and is perpendicular to the vertical plane defined by the slot 20.

It should be observed that FIG. 2 illustrates the centre position of the slot 20. However, the slot 20 can be located in another suitable position on the upper edge surface of the inner 18 wall, such as displaced from the centre of the inner 18 wall, located in the lower edge surface of the inner 18 wall or in any other position within the wall.

Note that at least an edge surface of the slot 20 comes into electric contact, physical contact, with the coupling mean 16. Thus, the coupling 16 means can be located such that it comes into electrical contact with the vertical edge surfaces of the slot 20.

The coupling 16 element must be an electrically conductive material, preferably a rigid metal such as aluminium coaxial or bar with a rectangular, circular, or the like cross section.

Any suitable mechanical fastening 17 means, such as a screw, may be used to support the coupling 16 element on the slot 20 in this position. That is, each inner 18 wall and its coupling 16 element are rigidly connected to each other by means of the mechanical fastening 17. Accordingly, a desired thermal path is formed by the connection between the coupling 16 element, fastening 17 element, each inner 18 wall and the remainder of the housing 11. This thermal path dissipates heat generated during use of the high power filter.

Since the coupling 16 element is rigidly connected directly to the inner 18 wall, rather than being connected indirectly to the housing 11 through an adjusting device or the like, the filter can withstand relatively greater mechanical loads without displacement or deflection of the coupling structure.

As illustrated in FIG. 3, the coupling 16 element and the inner 18 wall can optionally be made in a single piece. For instance, a suitable metal is melted and supplied to a suitable mold. On the other hand, each coupling 16 element can be directly welded on any of the edge surfaces of the slot 20.

Note that the inner 18 wall comes into contact with the upper lid and the remainder of the housing 11; hence, each inner 18 wall provides an optimum thermal path for the heat that is generated during performance of the filter.

It should be noted that a resonator 14 could be located in a corresponding resonant cavity 15. The resonators are preferably made of a dielectric or metallic material, and the supports are preferably made of quartz, for example. However, any other suitable resonators and supports may be used.

In general, tuning screws are mounted on the upper lid, not shown. The tuning screws are received through screw-threaded apertures in the upper lid, and are movable longitudinally toward and away from the resonators 14 upon being rotated in the apertures. This enables tuning of the filter to obtain a frequency response approximately or substantially equal to a specified response.

In FIG. 3 a fine tuning 31 screw is described, similarly mounted on the upper lid at a location centre above the slot 20. Moving the fine tuning 31 screw longitudinally performs fine tuning 31 of the filter. When the fine tuning 31 screw has been placed relative to the coupling 16 element in this maimer, it defines an effective length of the coupling 16 element along the cavities 15 so that the specified frequency response of the filter can be achieved more closely.

Note that the coupling 16 element can be of differing sizes and shapes, each of which is designed to provide a correspondingly different coupling of the resonant cavities 15. Accordingly, the filter can be tuned by varying both the actual length and the effective length of the coupling 16 element to allow a predetermined passband of the received wave to pass through the filter.

The present invention has been described with reference to an example. Those skilled in the art as taught by the foregoing description may contemplate improvements, changes and modifications. Such improvements, changes and modifications are intended to be covered by the appended claims.

The invention claimed is:

1. A direct coupled resonator filter having a plurality of resonant cavities such that an inner wall separates two adjoining resonant cavities which have top and bottom walls and which are coupled by means of a coupling means, characterised in that the inner wall includes a slot defined by at least one edge surface intermediate said top and bottom walls and extending from said one edge surface to an upper or lower edge of said inner wall, with the coupling means making electrical contact with at least said edge surface of the slot and extending in a direction substantially perpendicular to a plane of said inner wall.

2. A direct coupled resonator filter according to claim 1, wherein the edge surface of the slot is a horizontal edge surface extending in a direction substantially parallel to said top wall.

3. A direct coupled resonator filter according to claim 1, wherein both the inner wall and the coupling means are made of metallic material.

4. A direct coupled resonator filter according to claim 1, each cavity having a resonator.

5. A direct coupled resonator filter according to claim 4, wherein the resonator is a dielectric resonator.

6. A direct coupled resonator filter according to claim 4, wherein the resonator is a coaxial resonator.

7. A direct coupled resonator filter according to claim 3, wherein the slot is located in an upper edge surface of the inner wall and has a closed bottom defined by said inner wall.

8. A direct coupled resonator filter according to claim 7, each inner wall being in contact with an upper lid, surrounding walls, other inner walls and a bottom lid of a housing of the filter.

9. A direct coupled resonator filter according to claim 8, a mechanical fastening means being adapted to fasten each coupling means to each inner wall.

10. A dielectric resonator filter according to claim 9, the mechanical fastening means being a screw.

11. A direct coupled resonator filter according to claim 1, the coupling means and the inner wall being made in a single piece of the same metallic material.

12. A direct coupled resonator filter according to claim 1, wherein said coupling means comprises a probe.

13. A direct coupled resonator filter according to claim 12, wherein said probe has different portions with different cross sections.

* * * * *